US009723916B2

(12) United States Patent
Chen

(10) Patent No.: US 9,723,916 B2
(45) Date of Patent: Aug. 8, 2017

(54) ELECTRIC LIFTING DEVICE

(71) Applicant: HANGZHOU DECHANG HARDWARE & FURNITURE CO., LTD., Hangzhou, Zhejiang Province (CN)

(72) Inventor: Dechang Chen, Hangzhou (CN)

(73) Assignee: HANGZHOU DECHANG HARDWARE & FURNITURE CO., LTD., Hangzhou, Zhejiang Province (CN)

( * ) Notice: Subject to any disclaimer, the term of this patent is extended or adjusted under 35 U.S.C. 154(b) by 0 days.

(21) Appl. No.: 15/168,923

(22) Filed: May 31, 2016

(65) Prior Publication Data

US 2016/0345722 A1 Dec. 1, 2016

(30) Foreign Application Priority Data

May 29, 2015 (CN) ..... 2015 1 0288884

(51) Int. Cl.
*A47B 9/04* (2006.01)

(52) U.S. Cl.
CPC ..... *A47B 9/04* (2013.01); *A47B 2009/043* (2013.01); *A47B 2009/046* (2013.01)

(58) Field of Classification Search
USPC ..... 108/20, 147, 147.19; 248/188.2, 188.3, 248/188.4, 188.5
See application file for complete search history.

(56) References Cited

U.S. PATENT DOCUMENTS 6,935,250 B1 * 8/2005 Arnold ..... A47B 9/04 108/147
2002/0108544 A1 * 8/2002 Hsu ..... A47B 9/04 108/147.19
2006/0169862 A1 * 8/2006 Liu ..... A47B 9/04 248/422
2016/0198853 A1 * 7/2016 Liu ..... A47B 83/00 312/317.3

FOREIGN PATENT DOCUMENTS

CN 205527633 U * 8/2016 ..... B66F 19/00

* cited by examiner

*Primary Examiner* — Alfred Wujciak
(74) *Attorney, Agent, or Firm* — Muncy, Geissler, Olds & Lowe, P.C.

(57) ABSTRACT

An electric lifting device includes one driving mechanism and at least two transmission mechanisms, the two transmission mechanisms cooperating mutually and connected through a transmission bar assembly, with one transmission bar assembly driven by the driving mechanism. Each transmission mechanism includes a gearbox, a first driving gear, a second driving gear with axes of the first and second driving gears being crossed vertically, and lifting table legs disposed below at least two of the transmission mechanisms and driven by the second driving gear of the corresponding transmission mechanism to be lifted synchronously. The present invention employs only one driving mechanism, and with respect to the structure employing multiple driving mechanisms, the electric lifting device in the present invention can not only prevent interference to guarantee higher consistency, but also reduce devices to lower the difficult in control, thereby significantly reducing the cost.

9 Claims, 8 Drawing Sheets

ELECTRIC LIFTING DEVICE

CROSS-REFERENCE TO RELATED APPLICATIONS

This Non-provisional application claims priority under 35 U.S.C. §119(a) on Patent Application No(s). 201510288884.X filed in People's Republic of China on May 29, 2015, the entire contents of which are hereby incorporated by reference.

BACKGROUND OF THE INVENTION

Field of the Invention

The present invention relates to the field of furniture, and in particular to an electric lifting device.

Description of the Related Art

At present, in order to adapt to different heights and meet the requirements on user health, furniture has a free height conversion function within a certain range, i.e. having liftable legs.

For the existed equipment, the legs are driven to be lifted by a plurality of driving mechanisms. However, the consistency among the legs during lifting is poorer due to the adoption of a plurality of driving mechanisms, easily resulting in the fact of mutual interference and low reliability; and with a plurality of driving mechanisms, the equipment is complicate and is high in cost.

BRIEF SUMMARY OF THE INVENTION

The present invention provides an electric lifting device specific to the problems as described above, solving the problems of higher cost and poor consistency in the lifting of the legs due to the adoption of a plurality of driving mechanisms in the prior art.

The technical solution employed by the present invention is as follows. The electric lifting device includes a driving mechanism and at least two transmission mechanisms. The two transmission mechanisms cooperate with each other and are connected through a transmission bar assembly, and the transmission bar assembly is driven by the driving mechanism to rotate along an axis of the transmission bar assembly. Each transmission mechanism includes: a gearbox; at least one first driving gear rotationally mounted inside the gearbox, and the first driving gear coaxial with and relatively fixed with a part of the transmission bar assembly stretching into the transmission mechanism; at least one second driving gear mutually engaged with the first driving gear and rotationally mounted inside the gearbox, axes of the first and second driving gears being crossed vertically; and lifting table legs disposed below at least two of the transmission mechanisms and each lifting table leg driven by the second driving gear of the corresponding transmission mechanism to be lifted synchronously.

The driving gears of the present application may be bevel gears.

In order to guarantee the synchronous lifting of a plurality of lifting table legs, the present invention employs only one driving mechanism, and with respect to the structure employing multiple driving mechanisms, the electric lifting device provided by the present invention can not only prevent interference to guarantee higher consistency, but also reduce devices to lower the difficulty in control, thereby significantly reducing the cost.

The two transmission mechanisms cooperating mutually in the present application are connected through the transmission bar assembly. During operation, the driving mechanism drives the transmission bar assembly to rotate, the transmission bar assembly can drive the first driving gear connected therewith to rotate, and the first driving gear drives the second driving gear to rotate, and the second driving gear can drive the lifting table leg cooperating therewith to work. When a plurality of the first driving gears is present in one transmission mechanism, other first driving gears can be driven by the second driving gear to rotate, and the other first driving gears are connected with another transmission mechanism through the transmission bar assembly. In such a manner of design, multiple forms of lifting devices can be designed as required. In addition, when a plurality of the first driving gears is present in the same transmission mechanism, each first driving gear can be located at any position as long as no mutual interference is caused. That is, the transmission mechanism including a plurality of first driving gears can form multiple angles together with the transmission bar assembly connected therewith. The electric lifting device provided by the present invention is diverse in combination form and strong in applicability.

The present application can be applied to the field of furniture, such as a lifting table and a lifting bed, as required.

In practical application, the transmission mechanism may include two second driving gears in coaxial arrangement. At that time, the two second driving gears may be located on upper and lower sides of the first driving gear, respectively.

Further, to reduce friction, each transmission mechanism may further include a plurality of bearings mounted in the gearbox, an axis of each bearing may be coincident with an axis of the corresponding driving gear, and an inner race of each bearing may be relatively fixed with the cooperating driving gear.

Further, the transmission bar assembly may include two transmission bars and a hollow transmission loop bar. Ends of the two transmission bars may be internally sleeved on two ends of the transmission loop bar, respectively, and the other ends may be connected with the corresponding transmission mechanisms, respectively. The transmission bars and the transmission loop bar may be relatively fixed in a circumferential direction. That the transmission bars and the transmission loop bar are relatively fixed in a circumferential direction is for the purpose of guaranteeing the synchronous rotation between the transmission bars and the transmission loop bar.

To relatively fix the transmission bars and the transmission loop bar in the circumferential direction, a cross section of each transmission bar may not be circular, and an inner wall of the transmission loop bar may be adapted to outer walls of the transmission bars. Further, to guarantee the stress between the transmission bars and the transmission loop bar is uniform, the cross section of each transmission bar may be regularly polygonal, and the inner wall of the transmission loop bar may be adapted to the outer walls of the transmission bars.

Such structure allows the transmission bar assembly to adjust a distance between two ends as required, thereby adjusting a distance between the two transmission mechanisms cooperating therewith, and thus the electric lifting device has strong adaptivity.

Further, the transmission bar assembly may further include locking bolts, a side wall of the transmission loop bar may have a plurality of locking threaded holes, and the locking bolts and the corresponding locking threaded holes may match for fixing the transmission bars stretching into the transmission loop bar.

Further, the electric lifting device may further include a plurality of elongated telescopic mounting racks, and both the transmission mechanisms and the transmission bar assembly may be disposed in the mounting racks.

The telescopic mounting racks may cooperate with the transmission bar assembly to implement the adjustment of size, and thus the electric lifting device has strong adaptivity.

Further, each of the mounting racks may include two U-shaped racks and fasteners, each of the two U-shaped racks may include two opposite side walls and a bottom face, and the two side walls of each of the two U-shaped racks may have a plurality of fixing holes arranged at interval along a length direction. The two U-shaped racks may be nested and cooperate with each other, with the bottom faces abutted against each other. The fixing holes in the cooperating parts of the two U-shaped racks are in one-to-one correspondence, and every two fixing holes in correspondence are fixed through the fasteners.

The U-shaped racks are in such a structural form that the mounting racks are guaranteed to have a sufficient space for mounting of the transmission bar assembly and the transmission mechanisms. The two U-shaped racks may be nested and cooperate to adjust the length of the mounting racks, and each of the U-shaped racks can be relatively fixed via the fixing holes and the fasteners to achieve higher connection strength after the adjustment is guaranteed to be in place.

Further, for the sake of fitting, upper ends of two side walls of each U-shaped rack may further include outward turn-up edges.

With the configuration of the turn-up edges, the electric lifting device can cooperate with other components in a better way.

Further, to guarantee the components cooperating with the electric lifting device have higher stability, the mounting racks may be further fixedly provided with a plurality of supporting racks vertical thereto.

Further, each of the lifting table legs may include: a table foot cooperating with a supporting face; a lower casing pipe with a lower end mutually fixed with the table foot; an upper casing pipe with an upper end mutually fixed with the corresponding transmission mechanism, the upper casing pipe and the lower casing pipe being mutually nested and cooperating with each other; a screw rod located inside the upper casing pipe, having a top end relatively fixed with the second driving gear of the corresponding transmission mechanism and rotating along with the corresponding second driving gear; and a hollow guide bar located in the lower casing pipe and relatively fixed with the lower casing pipe or the table foot, the guide bar having an inner thread matching the screw rod.

The screw rod may be placed inside the upper casing pipe and the lower casing pipe to guarantee attractive appearance and enhance the structural strength of the lifting table legs.

Further, to reduce the processing cost, the guide bar may have a matching block fixed therein, and the matching block may be provided with the inner threads thereon.

In practical application, the matching block can be fixed on the guide bar by existed fixing means, such as riveting, welding or screws.

Further, the screw rod may include a threaded segment and a fixing segment located on an upper end, and the fixing segment may be internally sleeved on and relatively fixed with the second driving gear.

In practical application, the screw rods of all the lifting table legs may be the same in a turning direction. To guarantee the synchronous lifting of all the lifting table legs, in the two transmission mechanisms connected with the same transmission bar assembly, the first driving gears relatively fixed with the transmission bar assembly may be all located at the same side of the second driving gear of the corresponding transmission mechanism. Such configuration can guarantee that all the second gears are the same in a turning direction during working, and the second gears drive all the screw rods to rotate, thereby implementing synchronous lifting and falling.

Further, to prevent the gap between the upper casing pipe and the lower casing pipe from being overlarge causing shaking during lifting, the side walls on which the upper casing pipe and the lower casing pipe cooperate with each other may have gaskets fixed thereon.

With the configuration of the gaskets, the reliability of the structure of the lifting table legs can also be enhanced.

In practical application, the upper casing pipe and the lower casing pipe may be in an outer sleeve type or an inner sleeve type.

Further, to prevent dust from entering the lower casing pipe, the upper casing pipe may be externally sleeved on the lower casing pipe. An inner side wall at a lower end of the upper casing pipe may be fixedly provided with the gaskets, and an outer side wall on an upper end of the lower casing pipe may be fixedly provided with the gaskets.

Further, to prevent the upper casing pipe from sliding downwards in use, a downward-sliding prevention mechanism may be further disposed between the screw rod and the corresponding transmission mechanism thereof. The downward-sliding prevention mechanism may include a damping spiral spring and a damping sleeve. The damping sleeve may be fixedly sleeved on the upper part of the screw rod and below the transmission mechanism and may be relatively fixed with the screw rod. The damping sleeve may include a damping core and an outer casing pipe. A concave gap may be present between the damping core and the outer casing pipe. The damping spiral spring may be placed in the concave gap between the damping core and the outer casing pipe. An outer wall of the damping core and an inner wall of the damping spiral spring form sliding friction therebetween. A spiral direction of the damping spiral spring may be consistent with a spiral direction of the corresponding screw rod, an upper end of the damping spiral spring may be provided with a spring fixing handle, and the spring fixing handle and the transmission mechanism may be relatively fixed.

To guarantee higher transmission ratio and guarantee one driving mechanism drives all the transmission mechanisms and the lifting table legs to move, the driving mechanism may further includes: a turbine coaxially fixed on the transmission bar assembly; a transmission member engaged with the turbine; and a driving motor, driving the transmission member to rotate. The electric lifting device may further include a controller, including a driving chip controlling the driving motor to work; and the transmission member may be a worm, a gear set or a control operator.

The present invention has the following advantageous effects: in order to guarantee the synchronous lifting of a plurality of lifting table legs, the present invention employs only one driving mechanism, and with respect to the structure employing multiple driving mechanisms, the electric lifting device provided by the present invention can not only prevent interference to guarantee higher consistency, but also reduce devices to lower the difficulty in control, thereby significantly reducing the cost.

Reference numbers in the accompanying drawings are as follows:

1. Supporting rack, 2. Mounting rack, 3. Transmission bar assembly, 4. Driving mechanism, 5. Transmission mechanism, 6. Lifting table leg, 7. U-shaped rack, 8. Fixing hole, 9. Fastener, 10. Transmission bar, 11. Locking threaded hole, 12. Transmission loop bar, 13. Locking bolt, 14. First driving gear, 15. Gearbox, 16. Second driving gear, 17. Downward-sliding prevention mechanism mounting base, 18. Screw rod, 19. Upper casing pipe, 20. Bearing, 21. Fixing bolt, 22. Damping spiral spring, 23. Damping sleeve, 24. Damping core, 25. Outer casing pipe, 26. Spring fixing handle, 27. Fixing threaded hole, 28. Fixed segment, 29. Threaded segment, 30. Washer, 31. Lower gasket, 32. Lower casing pipe, 33. Matching block, 34. Inner thread, 35. Guide bar, 36. Upper gasket, 37. Table foot, 38. Turn-up edge, 39. Concave gap.

DETAILED DESCRIPTION OF THE INVENTION

The present invention will be described below in details in combination with the accompanying drawings.

Figure 1:
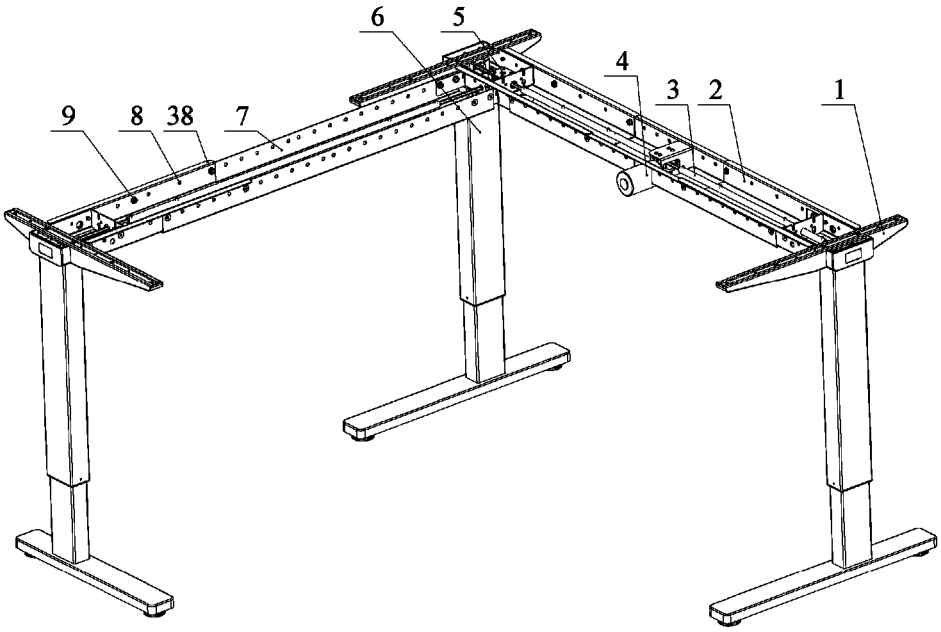
FIG. 1 is a structural schematic diagram showing an electric lifting device having three lifting table legs according to one embodiment of the present invention.

As shown in FIG. 1, an electric lifting device includes a driving mechanism 4 and at least two transmission mechanisms 5, the two transmission mechanisms 5 cooperate with each other and are connected through a transmission bar assembly 3, where the transmission bar assembly 3 is driven by the driving mechanism 4 to rotate along an axis of the transmission bar assembly 3.

As shown in FIGS. 1, 4, 5, 6, 7, and 8, each transmission mechanism 5 includes a gear box 15; at least one first driving gear 14 rotationally mounted inside the gearbox 15, and the first driving gear 14 being coaxial with and relatively fixed with a part of the transmission bar assembly 3 stretching into the transmission mechanism 5; at least one second driving gear 16 mutually engaged with the first driving gear 14 and rotationally mounted inside the gearbox 15, axes of the first driving gear 14 and the second driving gear 16 being crossed vertically; and lifting table legs 6, disposed below at least two of the transmission mechanisms, each lifting table leg being driven by the second driving gear of the corresponding transmission mechanism to be lifted synchronously.

In order to implement better cooperating and transmission between the first driving gear and the second driving gear, both the first driving gear and the second driving gear in the present embodiment are bevel gears, and in practical application, may also be other gears meeting conditions besides the bevel gears. The condition as described in the present embodiment is that the gears are mutually engaged and their axes are vertically crossed.

In order to guarantee the synchronous lifting of a plurality of lifting table legs, the present invention employs only one driving mechanism, and with respect to the structure employing multiple driving mechanisms, the electric lifting device provided by the present invention can not only prevent interference to guarantee higher consistency, but also reduce devices to lower the difficulty in control, thereby significantly reducing the cost.

Figure 3:
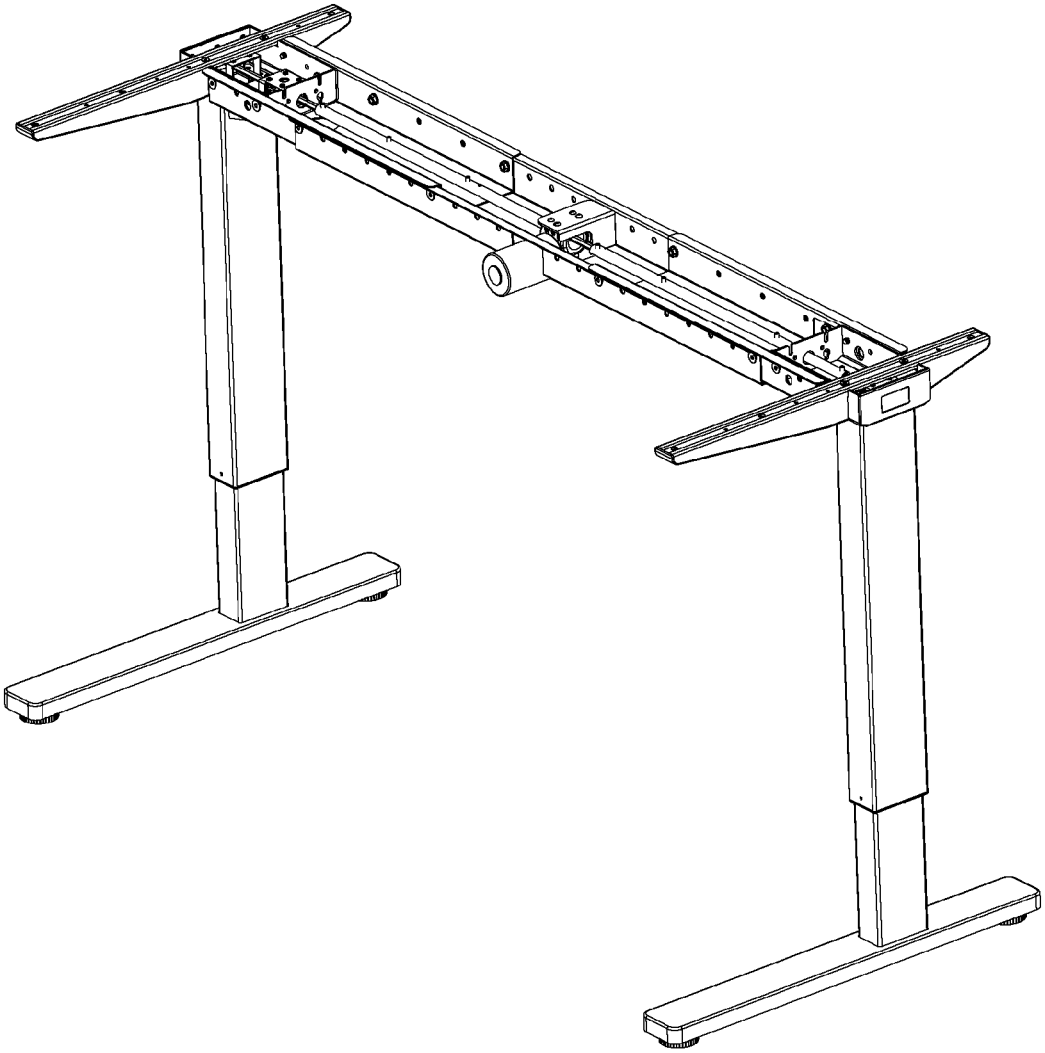
FIG. 3 is a structural schematic diagram showing an electric lifting device having two lifting table legs according to one embodiment of the present invention.
Figure 4:
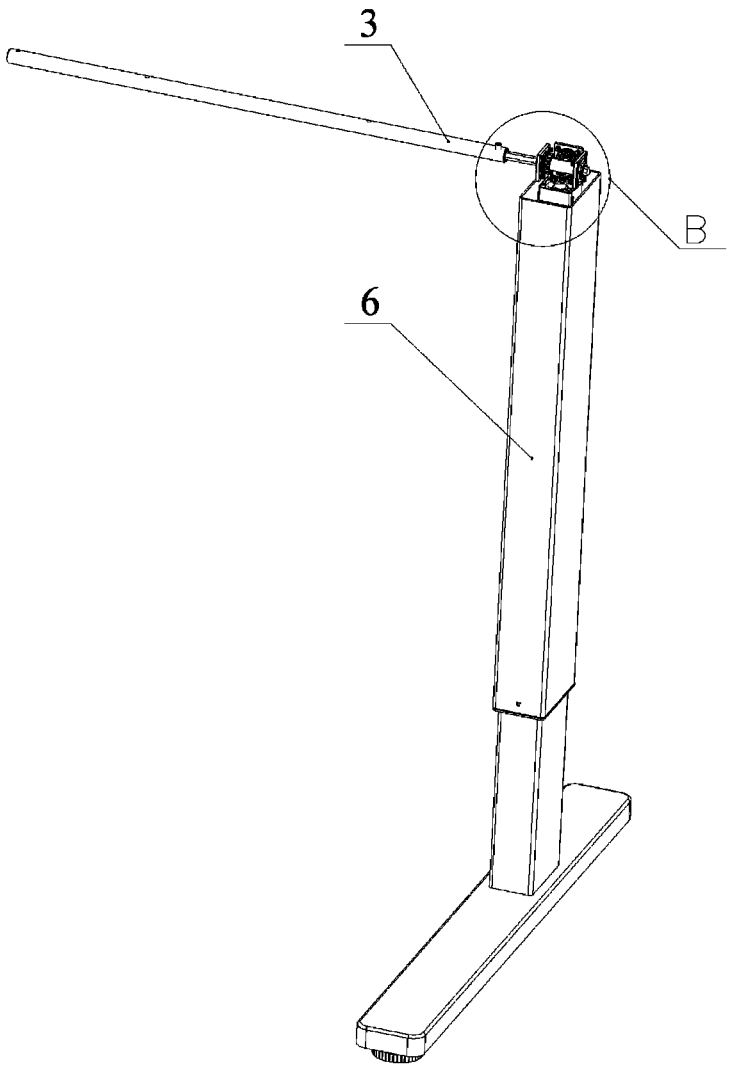
FIG. 4 is a structural schematic diagram showing a transmission mechanism and a lifting table leg.
Figure 5:
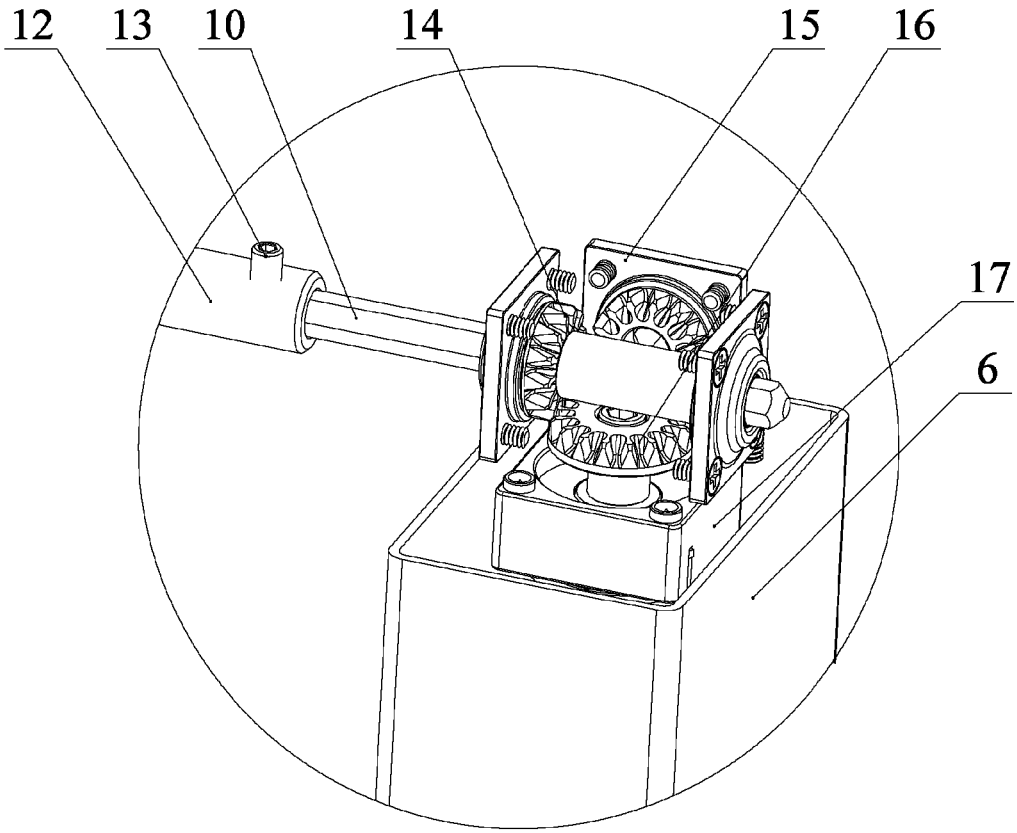
FIG. 5 is an enlarged view of B as shown in FIG. 4.
Figure 6:
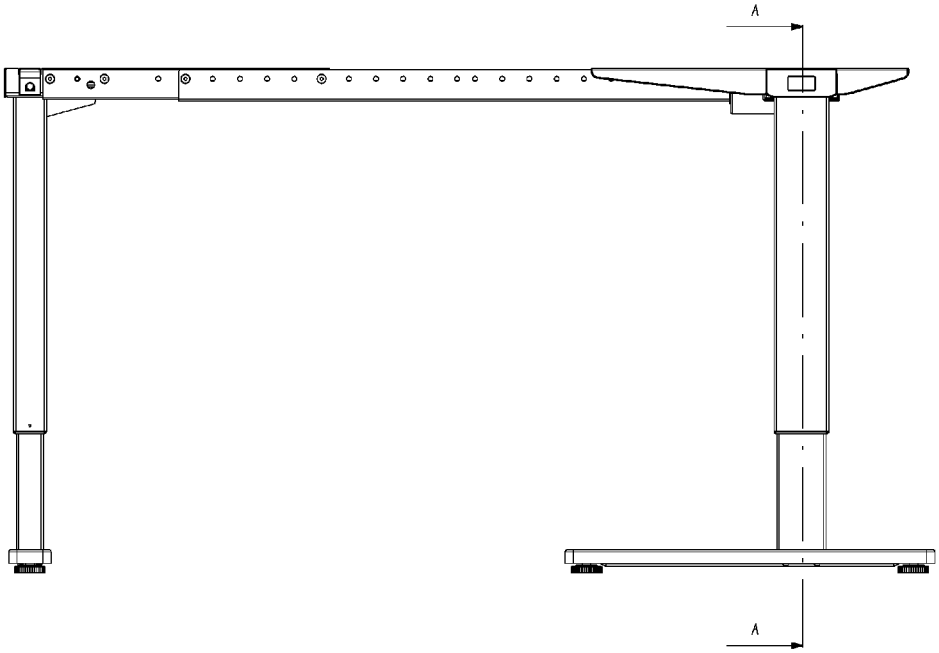
FIG. 6 is a front view of FIG. 1.
Figure 7:
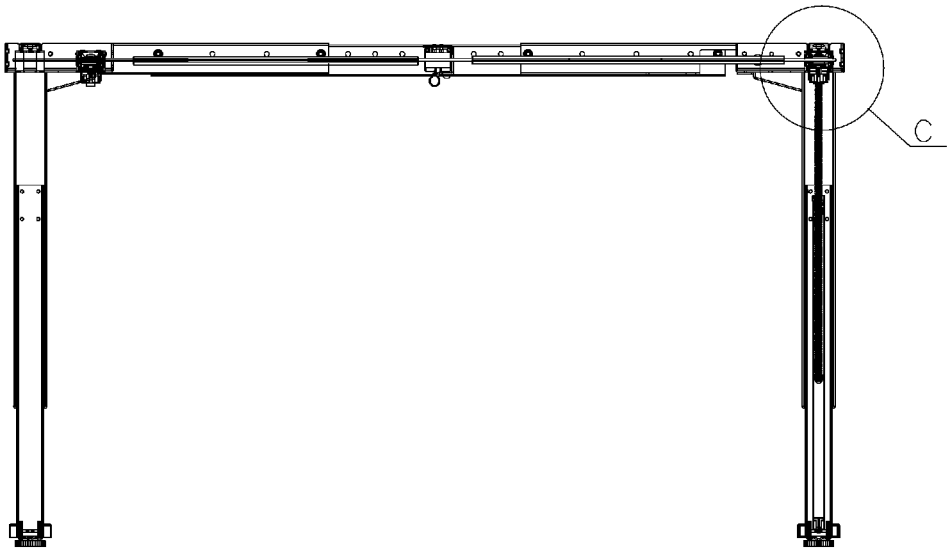
FIG. 7 is an A-A sectional view of FIG. 6.

In the present embodiment, the electric lifting device includes three lifting table legs 6, and may also have two lifting table legs disposed, as shown in FIG. 3, or more than three lifting table legs. The present application can be applied to the field of furniture, such as a lifting table and a lifting bed, as required.

In practical application, each transmission mechanism may include two second driving gears in coaxial arrangement. At that time, the two second driving gears are located on upper and lower sides of the first driving gear, respectively.

Figure 8:
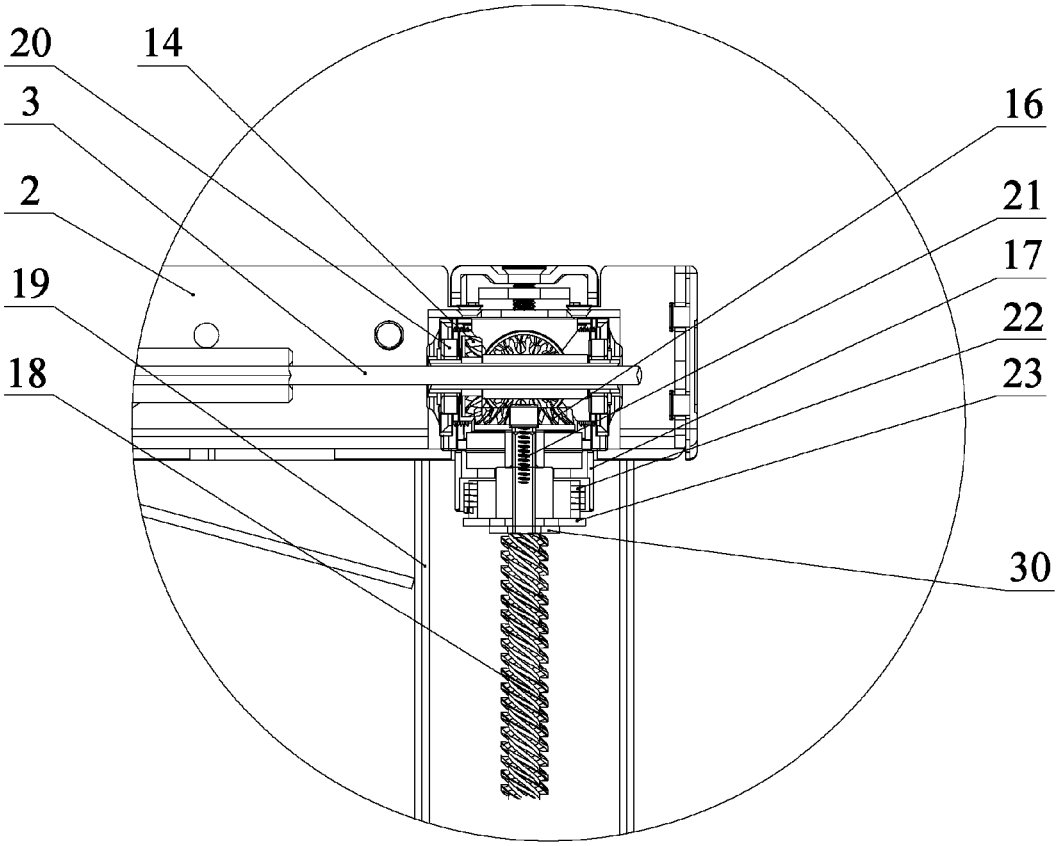
FIG. 8 is an enlarged view of C as shown in FIG. 7.

As shown in FIG. 8, to reduce friction, the transmission mechanism 5 further includes a plurality of bearings 20 mounted in the gearbox, an axis of each bearing is coincident with the axis of the driving gear corresponding thereto, and an inner race of each bearing is relatively fixed with the cooperating driving gear.

Figure 2:
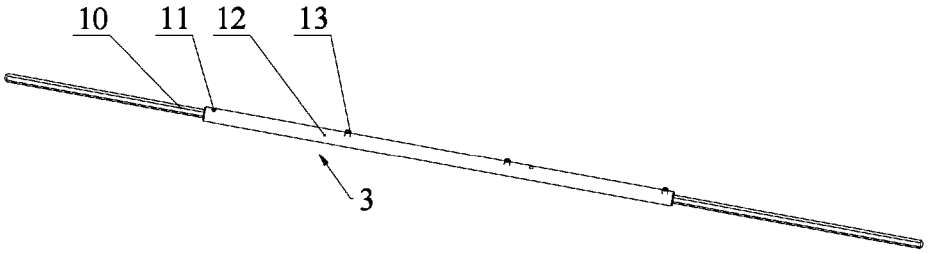
FIG. 2 is a structural schematic diagram showing a transmission bar assembly.

As shown in FIG. 2, in the present embodiment, the transmission bar assembly 3 includes two transmission bars 10 and a hollow transmission loop bar 12. Ends of the two transmission bars 10 are internally sleeved on two ends of the transmission loop bar 12, respectively, and the other ends are connected with the corresponding transmission mechanisms 5, respectively. The transmission bars 10 and the transmission loop bar 12 are relatively fixed in a circumferential direction. That the transmission bars 10 and the transmission loop bar 12 are relatively fixed in a circumferential direction is for the purpose of guaranteeing the synchronous rotation between the transmission bars 10 and the transmission loop bar 12.

In practical application, to relatively fix the transmission bars 10 and the transmission loop bar 12 in the circumferential direction, a cross section of each transmission bar 10 may not be circular, and an inner wall of the transmission loop bar 12 may be adapted to outer walls of the transmission bars 10.

To guarantee the stress between the transmission bars 10 and the transmission loop bar 12 is uniform, in the present embodiment, the cross section of each transmission bar 10 is regularly polygonal, and the inner wall of the transmission loop bar 12 is adapted to the outer walls of the transmission bars 10. The transmission bar assembly 3 further includes locking bolts 13, the side wall of the transmission loop bar 12 has a plurality of locking threaded holes 11, and the locking bolts 13 and the corresponding locking threaded holes 11 match for fixing the transmission bars 10 stretching into the transmission loop bar 12. Such structure allows the transmission bar assembly 3 to adjust a distance between two ends as required, thereby adjusting a distance between the two transmission mechanisms 5 cooperating therewith, and thus the electric lifting device has strong adaptivity. In practical application, the two transmission mechanisms 5 may be connected through a plurality of transmission bar assemblies 3. At that time, the two adjacent transmission bar assemblies 3 can share one transmission bar 10.

As shown in FIG. 1, the electric lifting device further includes a plurality of elongated telescopic mounting racks 2, and both the transmission mechanisms 6 and the transmission bar assembly 3 are disposed in the mounting racks.

Each of the mounting racks includes two U-shaped racks 7 and fasteners 9, each of the two U-shaped racks includes two opposite side walls and one bottom face, and the two side walls of each of the two U-shaped racks have a plurality of fixing holes 8 disposed at interval along a length direction. The two U-shaped racks are nested and cooperate with each other, with the bottom faces abutted against each other. The fixing holes 8 in the cooperating parts of the two U-shaped racks are in one-to-one correspondence, and every two fixing holes in correspondence are fixed through the fasteners 9.

The telescopic mounting racks 2 cooperate with the transmission bar assembly 3 to implement the adjustment of size, and thus the electric lifting device has strong adaptivity. The U-shaped racks 7 are in such a structural form that the mounting racks 2 are guaranteed to have a sufficient space for mounting of the transmission bar assembly 3 and the transmission mechanisms 5. The two U-shaped racks 7 are nested and cooperate to adjust the length of the mounting racks 2, and each of the U-shaped racks can be relatively fixed via the fixing holes 8 and the fasteners 9 to achieve higher connection strength after the adjustment is guaranteed to be in place.

For the sake of fitting, in the present embodiment, upper ends of two side walls of each U-shaped rack 7 further include outward turn-up edges 38. With the configuration of the turn-up edges 38, the electric lifting device can cooperate with other components in a better way.

To guarantee the components cooperating with the electric lifting device have higher stability, the mounting racks 2 are further fixedly provided with a plurality of supporting racks 1 vertical thereto. In the present embodiment, the supporting racks 1 are fixed on areas corresponding to the lifting table legs.

As shown in FIG. 6 to FIG. 10, each lifting table leg 6 includes: a table foot 37 cooperating with a supporting face; a lower casing pipe 32 with a lower end mutually fixed with the table foot 37; an upper casing pipe 19 with an upper end mutually fixed with the corresponding transmission mechanism 5, the upper casing pipe and the lower casing pipe being mutually nested and cooperating with each other; a screw rod 18 located inside the upper casing pipe 19, having a top end relatively fixed with the second driving gear 16 of the corresponding transmission mechanism 5 and rotating along with the corresponding second driving gear 16; and a hollow guide bar 35 located in the lower casing pipe 32 and relatively fixed with the lower casing pipe 32 or the table foot 37, the guide bar 35 having an inner thread 34 matching with the screw rod 18. In the present embodiment, the bottom of the guide bar 35 and the table foot 37 are fixed with each other.

The screw rod 18 is placed inside the upper casing pipe 19 and the lower casing pipe 32 to guarantee attractive appearance and enhance the structural strength of the lifting table legs 6.

In the present embodiment, to reduce the processing cost, the guide bar 35 has a matching block 33 fixed therein, and the matching block 33 is provided with the inner thread 34 thereon. In practical application, the matching block 33 can be fixed on the guide bar 35 by existed fixing means, such as riveting, welding or screws.

In the embodiment, when the lifting table leg 6 works, the screw rod 18 is driven to rotate by the second driving gear 16, and since the table foot 37 is immovable relative to the supporting face, that is, the inner thread 34 is immovable, the relative rotation between the screw rod 18 and the inner thread 34 is converted into the relative movement between the upper casing pipe 19 and the lower casing pipe 32.

In the present embodiment, the screw rod 18 includes a threaded segment 29 and a fixing segment 28 located on an upper end, and the fixing segment 28 is internally sleeved on and relatively fixed with the second driving gear 16. In the present embodiment, the top of the fixing segment 28 is provided with a fixing threaded hole 27, and the fixing segment 28 is fixed in the second driving gear 16 through the fixing bolt 21 matching with the fixing threaded hole 27.

In practical application, the screw rods 18 of all the lifting table legs 6 are the same in a turning direction. To guarantee the synchronous lifting of all the lifting table legs 6, in the two transmission mechanisms 5 connected with the same transmission bar assembly 3, the first driving gears 14 relatively fixed with the transmission bar assembly 3 are all located at the same side of the second driving gear 16 of the corresponding transmission mechanism. Such configuration can guarantee that all the second gears 16 are the same in a turning direction during working, and the second gears 16 drive all the screw rods 18 to rotate to implement synchronous lifting and falling.

To prevent the gap between the upper casing pipe 19 and the lower casing pipe 32 from being overlarge causing shaking during lifting, the side walls on which the upper casing pipe 19 and the lower casing pipe 32 cooperate with each other have gaskets fixed thereon. In practical application, the upper casing pipe 19 and the lower casing pipe 32 can be in an outer sleeve type or an inner sleeve type. In the present embodiment, to prevent dust from entering the lower casing pipe 32, the upper casing pipe 19 is externally sleeved on the lower casing pipe 32, an inner side wall at a lower end of the upper casing pipe 19 is fixedly provided with upper gaskets 36, and an outer side wall on an upper end of the lower casing pipe 32 is fixedly provided with lower gaskets 31. With the configuration of the gaskets, the reliability of the structure of the lifting table legs 6 can further be enhanced.

Figure 9:
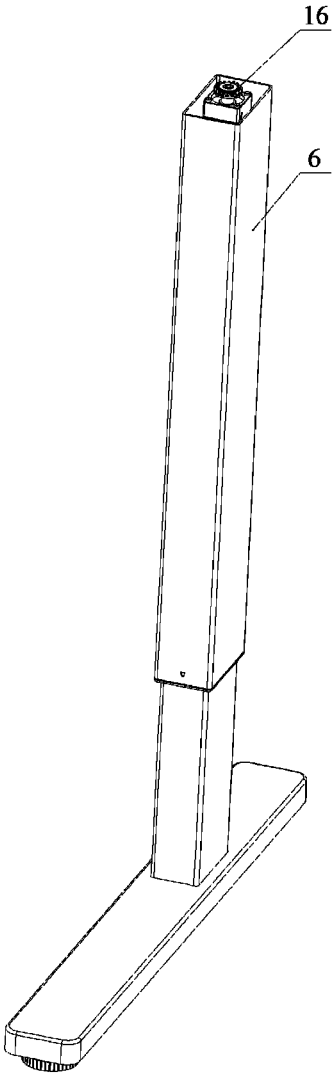
FIG. 9 is a structural schematic diagram showing a lifting table leg.
Figure 10:
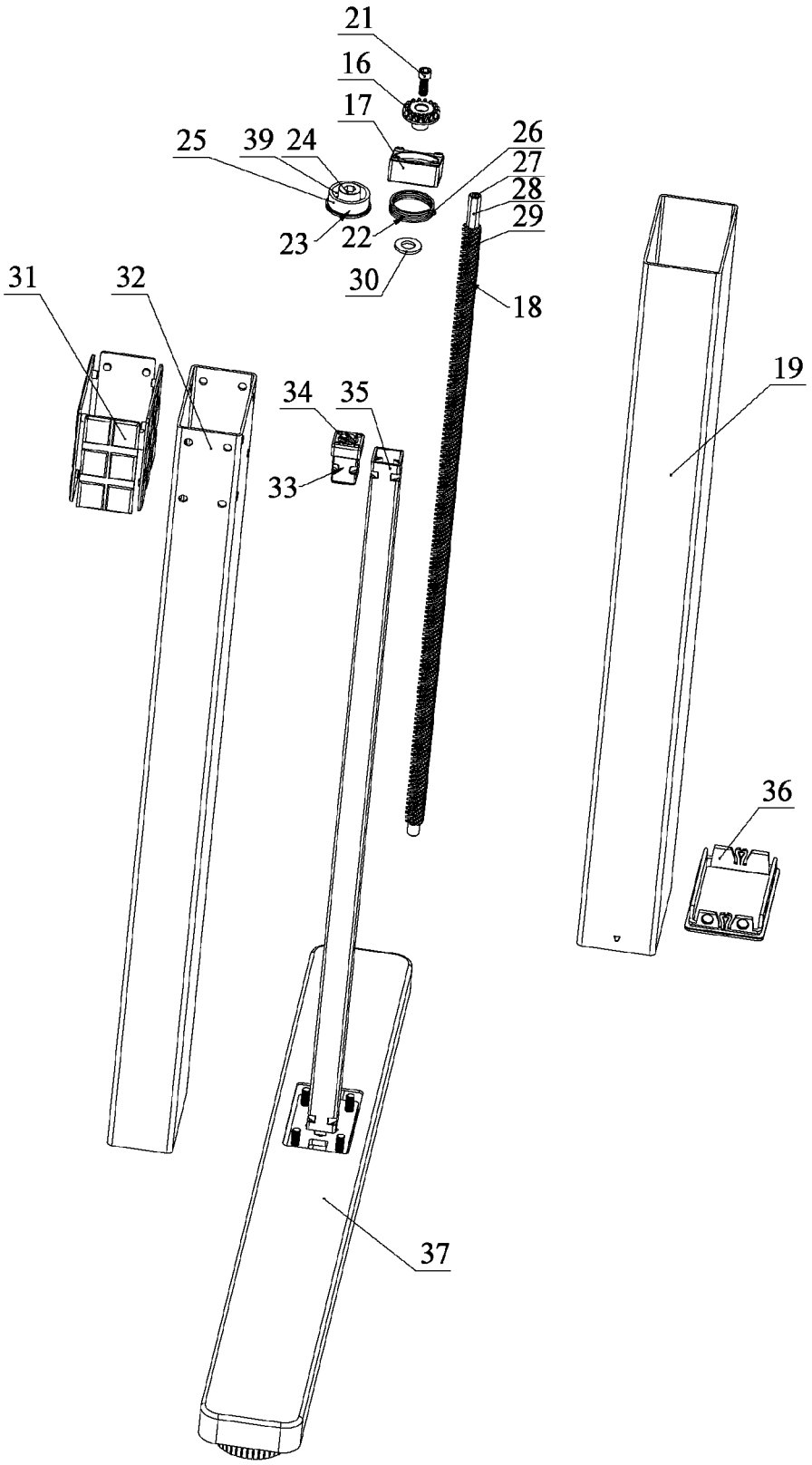
FIG. 10 is an exploded view of FIG. 9.

As shown in FIG. 8 to FIG. 10, to prevent the upper casing pipe 19 from sliding downwards in use, a downward-sliding prevention mechanism is further disposed between the screw rod 18 and the transmission mechanism 5 corresponding to the screw rod 18. The downward-sliding prevention mechanism includes a downward-sliding prevention mechanism mounting base 17 relatively fixed with the transmission mechanism 5. The downward-sliding prevention mechanism mounting base 17 has a damping spiral spring 22 and a damping sleeve 23 mounted therein. The damping sleeve 23 is fixedly sleeved on the fixing segment 28 of the screw rod 18 and below the transmission mechanism 5 and is relatively fixed with the screw rod 18. The damping sleeve 23 includes a damping core 24 and an outer casing pipe 25. A concave gap 39 is present between the damping core 24 and the outer casing pipe 25. The damping spiral spring 22 is placed in the concave gap 39 between the damping core 24 and the outer casing pipe 25. An outer wall of the damping core 24 and an inner wall of the damping spiral spring 25 form sliding friction therebetween. A spiral direction of the damping spiral spring 22 is consistent with a spiral direction of the corresponding screw rod 18. In the present embodiment, an upper end of the damping spiral spring 22 is provided with a spring fixing handle 26, and the spring fixing handle 26 is relatively fixed with the downward-sliding prevention mechanism mounting base 17.

In order to increase the contact area and protect the damping sleeves 23, the damping sleeve 23 in the present embodiment is abutted against the threaded segment 29 through a washer 30.

To guarantee higher transmission ratio and guarantee one driving mechanism 4 drives all the transmission mechanisms 5 and lifting table legs 6 to move, the driving mechanism 4 includes: a turbine coaxially fixed on the transmission bar assembly 3; a transmission member engaged with the turbine; and a driving motor driving the transmission member to rotate.

The electric lifting device further includes a controller including a driving chip controlling the driving motor to work, and the transmission member is a worm, a gear set or a control operator.

In the present embodiment, during working, the driving mechanism 4 drives one of the transmission bar assemblies 3 to rotate. The transmission bar assembly 3 can drive the first driving gear 14 connected therewith to rotate. The first driving gear 14 drives the second driving gear 16 to rotate, and the second driving gear 16 can drive the lifting table leg 6 cooperating therewith to work. When a plurality of the first driving gears 14 is present in one transmission mechanism 5, other first driving gears 14 can be driven by the second driving gear 16, and the other first driving gears 14 are connected with another transmission mechanism 5 through the transmission bar assembly 3. In such a manner of design, multiple forms of lifting devices can be designed as required. In addition, when a plurality of the first driving gears 14 is present in the same transmission mechanism 5, each first driving gear 14 can be located at any position as long as no mutual interference is caused, i.e. the transmission mechanism 5 including a plurality of the first driving gears 14 can form multiple angles together with the transmission bar assembly 3 connected therewith. The electric lifting device provided by the present invention is diverse in combination form and strong in applicability.

The description above is to be construed merely as the preferred embodiments of the present invention, but is not intended to limit the patent protection scope of the present invention, and all the equivalent structure variations made based on the description and accompanying drawings of the present application and applied to other relevant technical fields directly or indirectly are likewise intended to be included within the protection scope of the present invention.

What is claimed is:

1. An electric lifting device, comprising a driving mechanism and at least two transmission mechanisms, the two transmission mechanisms cooperating with each other and being connected through a transmission bar assembly, wherein the transmission bar assembly is driven by the driving mechanism to rotate along an axis of the transmission bar assembly;

each transmission mechanism comprises:

a gearbox;

at least one first driving gear, rotationally mounted inside the gearbox, and the first driving gear coaxial with and relatively fixed with a part of the transmission bar assembly stretching into the transmission mechanism;

at least one second driving gear, mutually engaged with the first driving gear and rotationally mounted inside the gearbox, axes of the first driving gear and the second driving gear being crossed vertically; and at least one lifting table leg disposed below at least two of the transmission mechanisms, and each lifting table leg driven by the second driving gear of the corresponding transmission mechanism to be lifted synchronously, wherein the transmission bar assembly comprises two transmission bars and a hollow transmission loop bar, ends of the two transmission bars are internally sleeved on two ends of the transmission loop bar, respectively, and the other ends are connected with the corresponding transmission mechanisms, respectively; and the transmission bars and the transmission loop bar are relatively fixed in a circumferential direction.

2. The electric lifting device as claimed in claim 1, wherein the transmission bar assembly further comprises locking bolts, a side wall of the transmission loop bar has a plurality of locking threaded holes, and the locking bolts and the corresponding locking threaded holes match for fixing the transmission bars stretching into the transmission loop bar.

3. The electric lifting device as claimed in claim 1, further comprising a plurality of elongated telescopic mounting racks, both the transmission mechanisms and the transmission bar assembly being disposed in the mounting racks.

4. The electric lifting device as claimed in claim 3, wherein each of the mounting racks comprises two U-shaped racks and fasteners, each of the U-shaped racks comprises two opposite side walls and one bottom face, and the two side walls of each of the U-shaped racks have a plurality of fixing holes arranged at interval along a length direction; the two U-shaped racks are nested and cooperating with each other, with the bottom faces abutted against each other; the fixing holes in cooperating parts of the two U-shaped racks are in one-to-one correspondence, and every two fixing holes in correspondence are fixed through the fasteners.

5. The electric lifting device as claimed in claim 1, wherein each of the lifting table legs comprises:

a table foot, cooperating with a supporting face;

a lower casing pipe, with a lower end mutually fixed with the table foot;

an upper casing pipe, with an upper end relatively fixed with the corresponding transmission mechanism, the upper casing pipe and the lower casing pipe being nested and cooperating with each other;

a screw rod, located inside the upper casing pipe, having a top end relatively fixed with the second driving gear of the corresponding transmission mechanism, and rotating along with the corresponding second driving gear; and a hollow guide bar, located in the lower casing pipe and relatively fixed with the lower casing pipe or the table foot, the guide bar having an inner thread matching with the screw rod.

6. The electric lifting device as claimed in claim 5, wherein side walls on which the upper casing pipe and the lower casing pipe cooperate mutually are fixedly provided with gaskets.

7. The electric lifting device as claimed in claim 6, wherein the upper casing pipe is externally sleeved on the lower casing pipe, an inner side wall at a lower end of the upper casing pipe is fixedly provided with the gaskets, and an outer side wall on an upper end of the lower casing pipe is fixedly provided with the gaskets.

8. The electric lifting device as claimed in claim 5, wherein a downward-sliding prevention mechanism is disposed between the screw rod and the transmission mechanism corresponding to the screw rod, the downward-sliding prevention mechanism comprises a damping spiral spring and a damping sleeve, the damping sleeve is fixedly sleeved on an upper part of the screw rod and below the transmission mechanism and is relatively fixed with the screw rod, the damping sleeve comprises a damping core and an outer casing pipe, a concave gap is present between the damping core and the outer casing pipe, the damping spiral spring is placed in the concave gap between the damping core and the outer casing pipe, an outer wall of the damping core and an inner wall of the damping spiral spring form sliding friction, a spiral direction of the damping spiral spring is consistent with a spiral direction of the corresponding screw rod, an upper end of the damping spiral spring is provided with a spring fixing handle, and the spring fixing handle and the transmission mechanism are relatively fixed.

9. The electric lifting device as claimed in claim 1, wherein the driving mechanism comprises:

a turbine, coaxially fixed on the transmission bar assembly;

a transmission member, engaged with the turbine; and a driving motor, driving the transmission member to rotate;

the electric lifting device further comprises a controller, the controller comprising a driving chip controlling the driving motor to work; and the transmission member is a worm, a gear set, or a control operator.

* * * * *